US005888091A

United States Patent [19]

McQuilkin Murr

[11] Patent Number: 5,888,091

[45] Date of Patent: Mar. 30, 1999

[54] TERMINATION OF AN INSULATED ELECTRICAL CONDUCTOR

[75] Inventor: Keith McQuilkin Murr, York, Pa.

[73] Assignee: The Whitaker Corporation, Wilmington, Del.

[21] Appl. No.: 984,556

[22] Filed: Dec. 3, 1997

Related U.S. Application Data

[60] Provisional application No. 60/042,359 filed Mar. 25, 1997 and provisional application No. 60/638,902 filed Feb. 28, 1997.

[51] Int. Cl. [6] ..... H01R 4/24

[52] U.S. Cl. ..... 439/427; 439/387

[58] Field of Search ..... 439/387, 396, 439/417, 418, 425, 427, 428, 443, 422, 423, 424

[56] References Cited

U.S. PATENT DOCUMENTS

| | | | |
|---|---|---|---|
| 3,659,247 | 4/1972 | Chaney et al. . | |
| 3,715,627 | 2/1973 | D'Ausilio . | |
| 3,951,503 | 4/1976 | Caulkins | 439/427 |
| 4,176,896 | 12/1979 | Wehling . | |
| 4,413,872 | 11/1983 | Rudy, Jr. et al. | 439/427 |
| 4,825,540 | 5/1989 | Kelly . | |
| 4,857,016 | 8/1989 | Benscoter et al. . | |
| 4,875,871 | 10/1989 | Booty, Sr. et al. . | |
| 4,961,713 | 10/1990 | McCraken et al. . | |
| 5,147,215 | 9/1992 | Pritulsky | 439/344 |
| 5,318,458 | 6/1994 | Thorner | 439/427 |
| 5,391,088 | 2/1995 | Tomchak et al. . | |

*Primary Examiner*—Lincoln Donovan

*Attorney, Agent, or Firm*—Katherine A. Nelson; Anton P. Ness

[57] ABSTRACT

A termination 76 of a conductor and a terminal includes an electrical conductor 46 having insulation 40 therearound and extending to an end 48 exposed at an end 42 of the insulation. The terminal 60 includes a termination end 70 having at least a pair of cutting edges 72 aligned with the conductor 46. The cutting edges 72 are sliced into the end of the conductor 46 a selected axial distance and receive a first portion 52 of the conductor 46 between the cutting edges 72 and outer portions 54 of the conductor 46 along outer surfaces of the termination end 70 of the terminal 60.

11 Claims, 5 Drawing Sheets

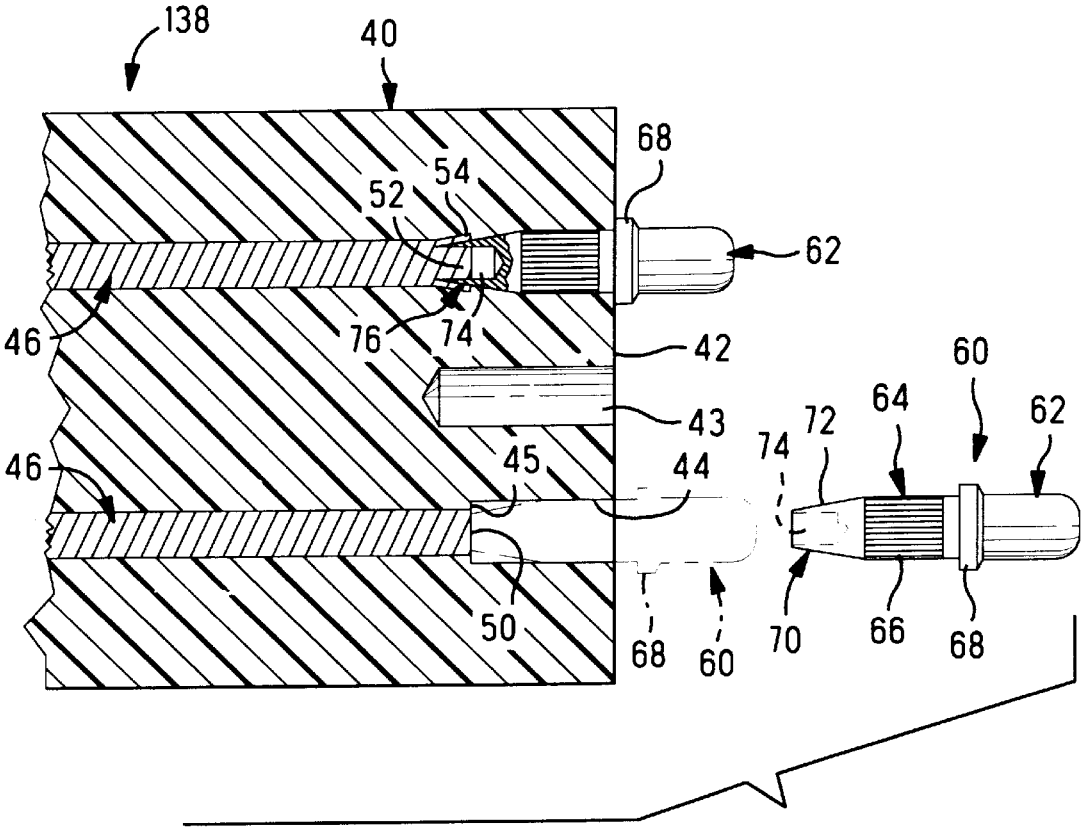
FIG. 2
FIG. 3
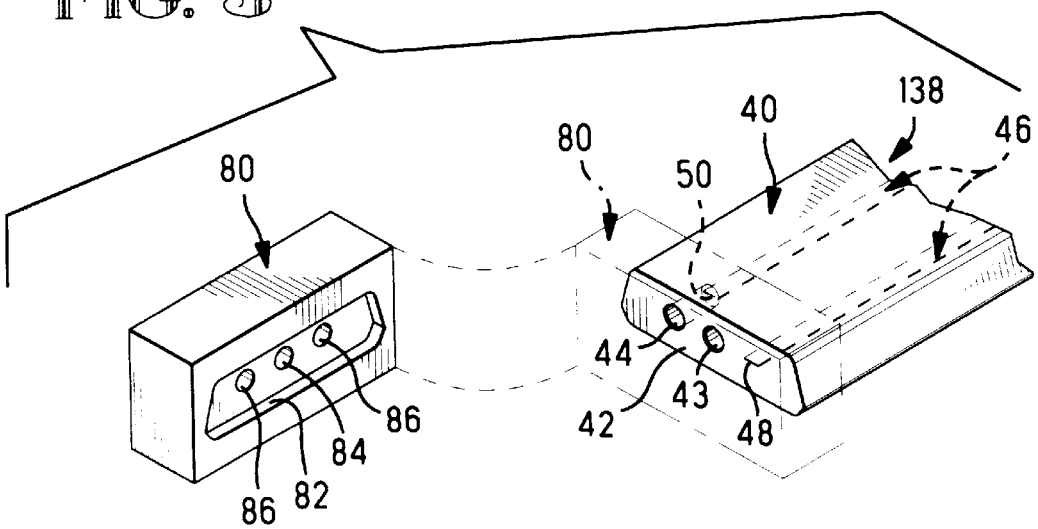

TERMINATION OF AN INSULATED ELECTRICAL CONDUCTOR

This application claims the benefit of U.S. Provisional Appln. No. 60/042,359 filed Mar. 25, 1997 and provisional Appln. No. 60/638,902 filed Feb. 28, 1997.

FIELD OF THE INVENTION

This invention is directed to electrical terminals and particularly to the termination of a terminal to an insulated conductor.

BACKGROUND OF THE INVENTION

U.S. Pat. No. 5,391,088 discloses a connector for interconnecting components of a flat electroluminescent strip light system. The components therein include elongate strips having conductors extending therethrough and exposed at an end surface. The connector therein uses conductive gel, or the like, to terminate the terminals of the connector to the respective conductors in the elongate strip. The connector is secured to the end of the strip by a mechanical fastener. The use of conductive gels and similar materials, however, require additional steps in manufacturing and are relatively expensive. With flat conductors, the actual area of engagement of the gel or adhesive to the end edge of the conductor is relatively small. Additionally, the gels and adhesives may be affected by the environmental conditions under which they are used. It is desirable, therefore, to provide a mechanical termination between such a conductor and a mating connector that does not require the use of a conductive gel or adhesive.

SUMMARY OF THE INVENTION

The present invention is directed to a termination of a conductor and a terminal including an electrical conductor having insulation therearound and extending to an end exposed at an end of the insulation, the conductor having a selected transverse dimension, and a terminal having a termination end, the termination end having at least a pair of cutting edges aligned with the conductor, the cutting edges being sliced into the end of the conductor a selected axial distance and receiving at least a first portion of the conductor therebetween.

In one embodiment of the invention the cutting edges of the terminal are spaced closer together than the selected dimension, such that outer portions of the conductor are disposed along outer surfaces of the termination end of the terminal.

In accordance with another embodiment of the invention, a connector is provided with terminals having the connecting end at the connector mating face provided with cutting edges as previously described. The connector, therefore, can be terminated directly to the end of an insulated conductor.

The present invention provides a mechanical termination between an insulated conductor and a mating connector that does not require the use of a conductive gel or adhesive. The present invention further provides a connector having a terminal adapted to be terminated directly to the insulating conductor at the mating face of the connector.

Embodiments of the invention will now be described by way of example with reference to the following drawings.

BRIEF DESCRIPTION OF THE DRAWINGS

FIG. 2 is a sectional and partially exploded view of a pair of conductors in an insulated strip with one conductor terminated in accordance with the invention and the other conductor prior to termination with the terminal exploded therefrom with a terminal in an initial stage of assembly shown in phantom.

FIG. 3 is an isometric view of a fixture used in preparing the strip and conductors therein to be terminated in accordance with the invention and the end of a strip with one of the conductors so prepared.

DETAILED DESCRIPTION OF THE DRAWINGS

For purposes of illustrating the present invention, the termination and terminal therefor will be illustrated by way of example in terminating conductors of a light strip. It is to be understood that the invention is not limited to light strip applications. The termination is particularly suitable for use with conductors made from a soft material. The insulation for the conductors is preferably one having a low durometer such that the cutting edges of the terminal can cut the insulation as well as the conductor as the termination is made.

Figure 1:
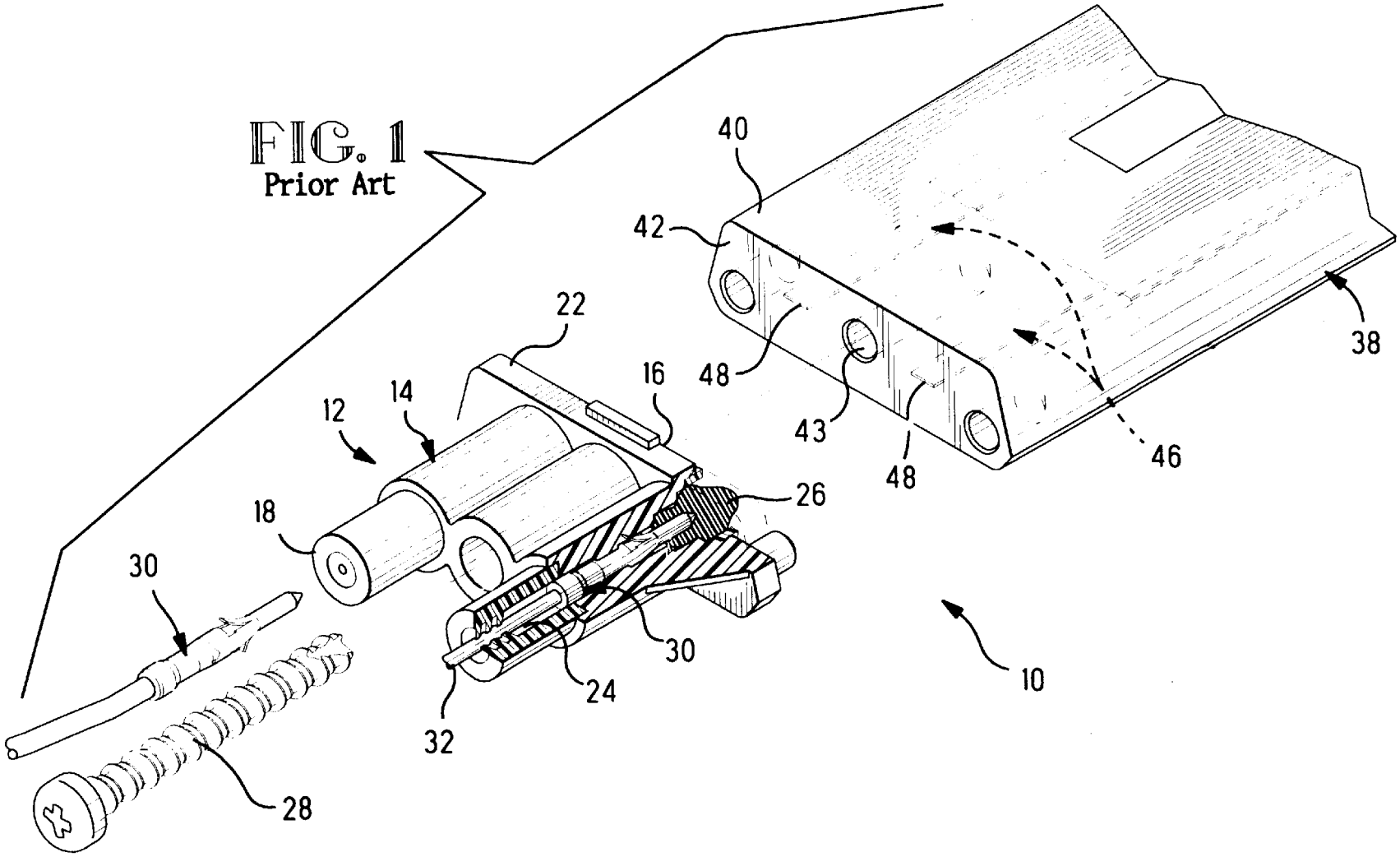
FIG. 1 Prior Art
FIG. 1 is an isometric view of a prior art connector, the connector being exploded from a light strip with a portion of the housing being sectioned to illustrate the mating face of a terminal of the connector.

FIG. 1 illustrates an assembly 10 including connector 12 and light strip 38 of the prior art. For purposes of clarity, only the elongate power conductors 46 are shown in the light strip. Connector 12 includes a housing 14 having a mating face 16, a rear face 18 and a plurality of terminal receiving passageways 24 extending therethrough. Housing 14 further includes an outwardly extending flange 22 dimensioned to be substantially aligned with the end face 42 of elongate light strip 38. Connector 12 further includes at least two terminals 30 terminated to insulated wires 32 that are dimensioned to be received in the terminal receiving passageways 24. As can be seen in FIG. 1, the end of contact 30 is disposed rearwardly of the mating face 16 to define a counter bore having a specific volume of conductive gel 26 disposed therein. The conductive gel 26 protrudes from the end of the passageway 24 and is adapted to be compressed and deformed when attached to the elongate light strip, as described in U.S. Pat. No. 5,391,088. The elongate light strip member 38 includes a pair of conductors 46 extending through an elongate strip of insulating material 40, the conductors having ends 48 exposed on end face 42 of strip 38. End face 42 further includes an aperture 43 dimensioned to receive a fastener 28 when the connector 12 and light strip 38 are assembled together.

FIGS. 2 through 5 illustrate one embodiment of the present invention, in which terminal 60 is terminated at 76 to conductor 46 in an insulated strip 138.

Terminal 60 of the present invention includes a first connecting portion 62, an intermediate portion 64, and a termination end 70. Intermediate portion 64 includes a plurality of ribs 66 extending therealong adapted to grip insulating material 40 as the terminal 60 is positioned in strip 138. It is to be understood the intermediate portion may have configurations, such as a spiral rib or circular rings, or the like for gripping the insulating material 40. The intermediate portion further includes a flange 68 proximate the first connecting portion 62 thereof that defines a stop surface for engaging the forward face 42 of the strip 138 when terminal 60 is terminated to the strip 138. The termination end 70 includes at least a pair of cutting edges 72 and a recess 74 extending into the terminating end from the cutting edges 72. In the embodiment of FIGS. 2 through 5, the outer profile of the termination end is frustoconical. The cutting edges 72 are spaced closer together than the selected dimension of the respective conductors 46 to which the terminal 60 is to be terminated.

Insulated strip 138 is similar to the previously described strip 38. The same reference numerals, therefore, will be used to illustrate the corresponding parts of the strip. Strip 138 includes insulation 40 having an end face 42 and an aperture 43 for receiving a fastener 28 therein in the same manner previously described. Strip 138 includes a pair elongate conductors 46 extending through the insulating material 40 and having ends 48 exposed on end face 42.

FIG. 2 illustrates a terminal 60 terminated to upper conductor 46 and a terminal 60 exploded from the lower conductor 46. FIG. 3 illustrates the preparation of strip 138 for termination to terminal 60. A fixture 80 having a recess 82 configured to receive the end of strip 138, as shown in phantom, includes a plurality of passageways 84,86 extending therethrough. The fixture 80 is aligned with the end face 42 of the strip 138 and respective fastener-receiving aperture 43 and terminal-receiving openings 44 are drilled into the end 42 of the strip 138. For purposes of illustration, only one of the terminal-receiving openings 44 has been formed in the strip shown in FIG. 3. Aperture 43 extends into the insulation in the same manner previously described. The terminal-receiving openings 44 are drilled into the insulation 40 in alignment with the respective conductors 46. Formation of openings 44 removes some of the conductors 46 such that the respective ends 50 are recessed from the face 42 of the strip 138 and at the end 45 of the openings 44, as shown in FIGS. 2 and 3.

The depth of the openings 44 is less than the length of the terminal 60 measured from the terminating end 70 to flange 68 of intermediate portion 64, such that upon initial insertion of terminal 60 into the opening 44, the flange 68 is spaced outwardly of face 42 of the strip 138, as shown in phantom in FIG. 2. This spacing may be varied as desired by adjusting the depth of opening 44. After the terminals 60 have been positioned in the respective openings 44, the terminals are pressed into terminated position as shown representatively with respect to the upper conductor 46 in FIG. 2. As the terminal 60 is pressed inwardly the cutting edges 72 of the terminating section 70 cut into the conductor 46 a selected axial distance, such that a first portion 52 is received in the recess 74 of terminal 60 and outer or second portions 54 of the conductor extend along the outer surfaces of the terminating section 74, again as shown in FIG. 2. The axial distance that terminal 60 cuts into the conductor is essentially equal to the distance between the flange 68 and the face 42 of the strip when the terminal is initially inserted into the opening 44, as shown in phantom in FIG. 2.

The termination 76 provides an assured electrical connection between the terminal 60 and a respective conductor 46. The englongate ribs 68 engage the insulation 40 in an interference fit such that the terminal 60 is securely held in the opening 44 of strip 138.

The present invention is particularly suitable for use with conductors made from a soft metal such as soft copper or the like. The invention is not limited to flat conductors. The insulating material is one that has a low durometer and is preferably a thermoplastic resin. One such material is Surlyn® 9020 available from E.I. du Pont de Nemours and Company. Terminals 60 are made from a hard metal such as beryllium copper or the like. The material used for the terminals needs to be harder than that of the conductors so that the cutting edges of the terminating end will cut into the softer conductor to assure the termination. Preferably, the width of the terminating end 70 at the cutting edge is less than the selected transverse dimension of the conductor 46 to which terminal 60 is to be terminated.

Figure 4:
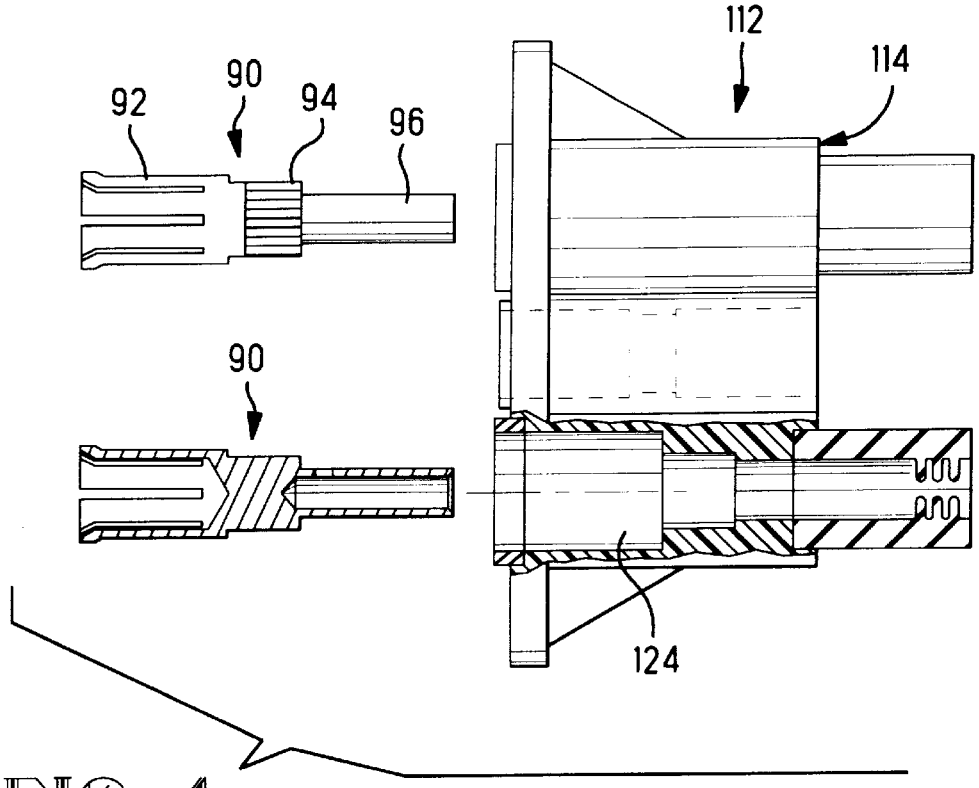
FIG. 4 is an exploded partially sectioned view of the connector to be mated with the terminated strip of the present invention.
Figure 5:
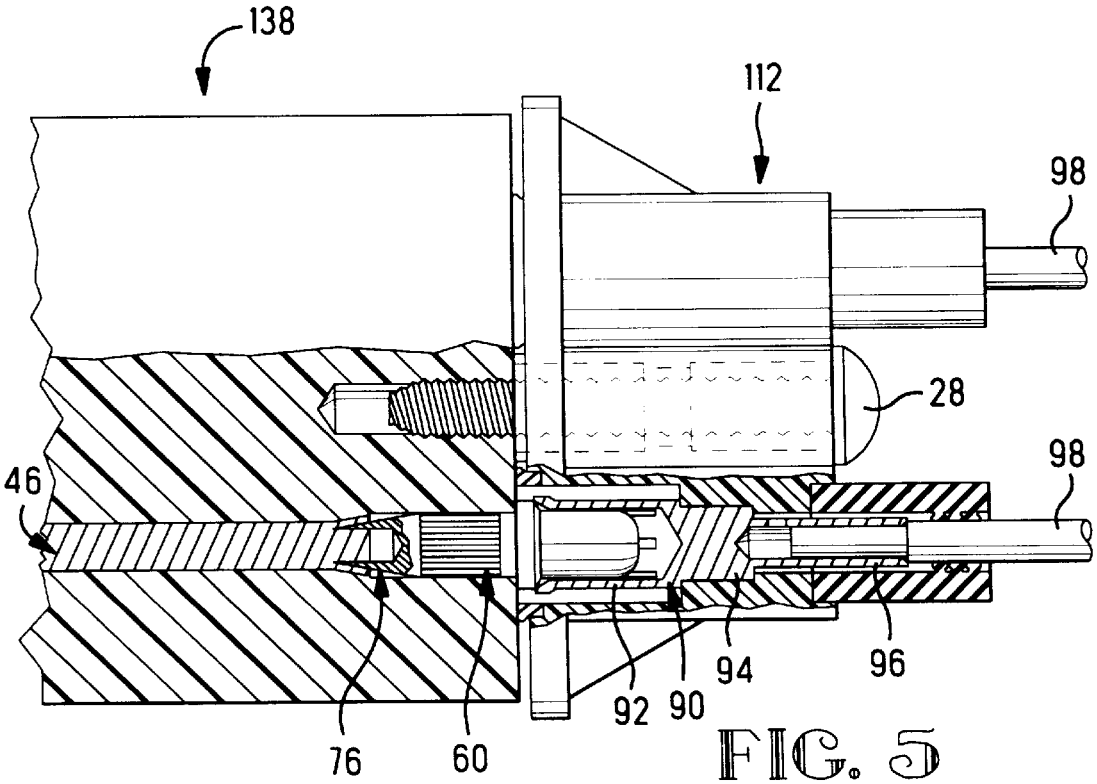
FIG. 5 is a partially sectioned view of the connector of FIG. 4 with the terminated conductors of the present invention.

FIG. 4 illustrates a representative mating connector 112 having a housing 114 and a pair of terminals 90 disposed in respective terminal receiving passages 124. FIG. 5 illustrates connector 112 mated to or in electrical engagement with strip 138. Terminal 90 includes a mating end 92 configured to mate with first connecting portion 62 of terminal 60, an intermediate ribbed portion 94 and a termination end 96 adapted to be terminated to a cable 98 as illustrated in FIG. 5. Terminal 90 is inserted into the housing 114 from the mating face thereof and is supported in position by side wall structure within passageway 124. Terminals 90 will not be pulled from housing 112 if stress is applied to the cable 98.

Figure 6:
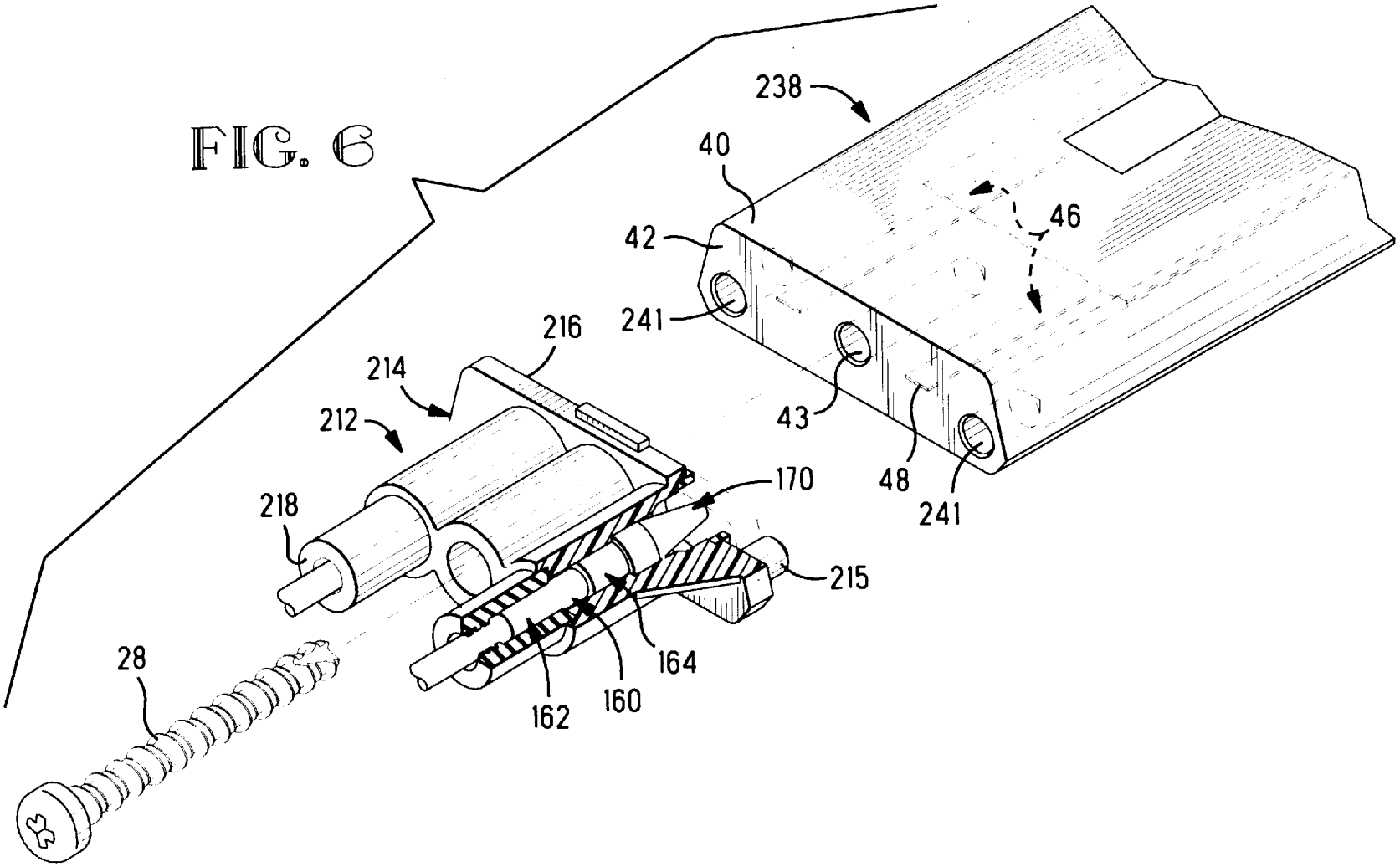
FIG. 6 is an isometric view of a connector made in accordance with the invention, the connector being exploded from a light strip with a portion of the housing being sectioned to illustrate the terminating face of a terminal therein.
Figure 7:
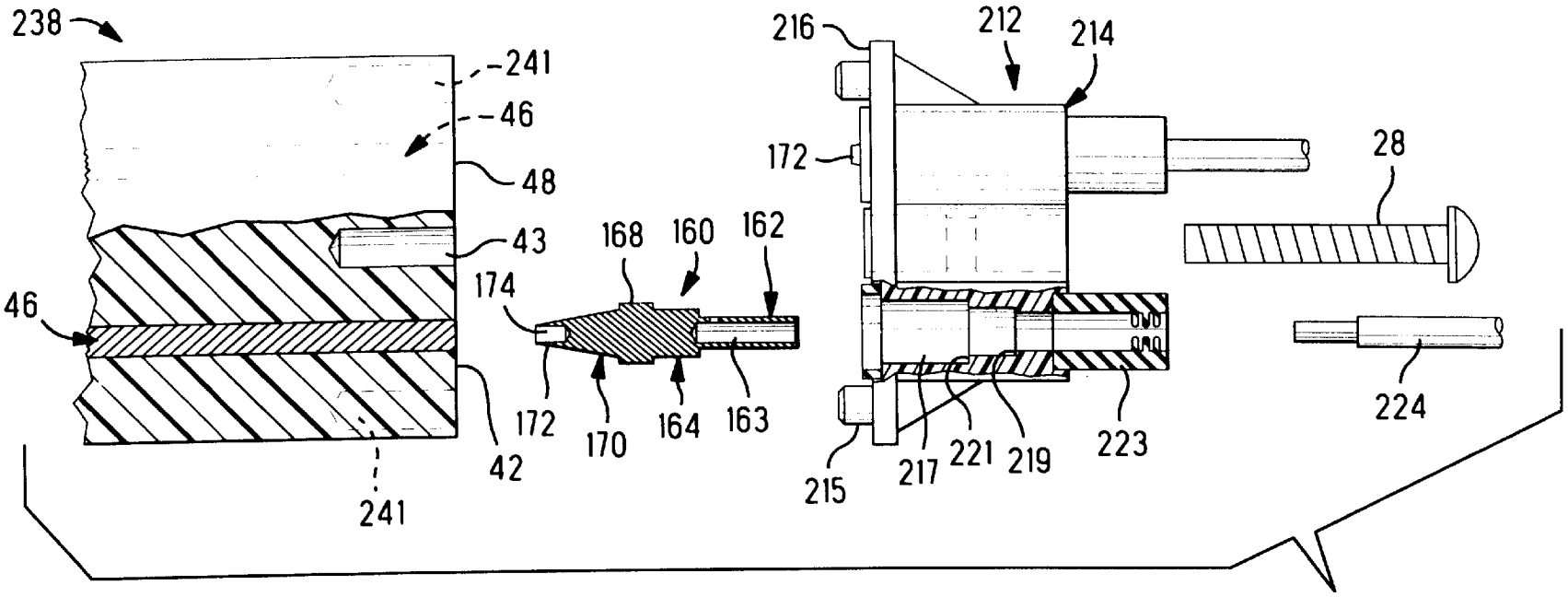
FIG. 7 is a partially sectioned and partially exploded view of the connector of FIG. 6 exploded from a partially sectioned insulated conductor.
Figure 8:
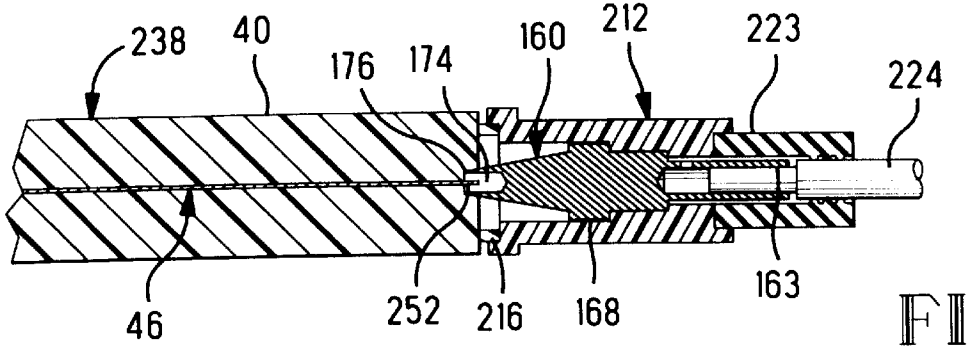
FIG. 8 is a sectioned view of the connector of FIG. 6 mated to the insulated conductor in accordance with the present invention.

FIGS. 6, 7 and 8 illustrate another embodiment of the present invention. Connector 212 includes a housing 214 having a mating face 216, a rear face 218, and at least a pair of terminal receiving passageways 217 extending therethrough in which are disposed terminals 160 having termination ends 170 exposed at the mating face 216 of the connector. Connector 212 is adapted to mate directly to the face 42 of an insulated conductor 238 and terminate to respective conductors 46 therein. Again, for purposes of illustration, the insulated conductor 238 is shown as light strip. Connector housing 214 includes two alignment posts 215 extending outwardly a first selected distance from the mating face 216 thereof.

Terminal 160 of the present invention includes a first connecting portion 162, an intermediate portion 164 and a termination end 170. The intermediate portion 164 has been knurled to provide a press fit within the corresponding terminal receiving passageway 217 of connector housing 214. The rear surface of the intermediate portion 164 is secured against the stop surface 219 within the passageway 217 such that the terminal 160 can not be pulled rearwardly from the housing 214. The first connecting end 162 has a wire crimp barrel 163 adapted to be crimped to a cable 224 by means known in the art. Connector 221 further includes a wire seal 223 disposed over the cable 224. It is to be understood other types of connecting sections may also be used. Intermediate portion 164 further includes an enlarged flange 168 forwardly thereof adapted to be positioned against stop surface 221 in terminal receiving passageway 217. The frustoconical termination section 170 extends forwardly from flange 168 and includes at least a pair of cutting edges 172. Cutting edges 172 are spaced closer together than the selected dimension of the respective conductors 46 to which the terminals 160 are to be terminated upon mating the connector 212 with the insulated strip 238.

Insulated strip 238 is similar to the previously described strips 38 and 138. The same reference numerals, therefore, will be used to illustrate the corresponding parts of the strip. Strip 238 includes insulation 40 having and end face 42 and an aperture 43 therein for receiving a fastener 28 in the same manner previously described. Strip 238 includes a pair of elongate conductors 46 extending through the insulating material 40 and having ends 48 exposed on the end face 42. Strip 238 further includes a pair of apertures 241 adapted to receive corresponding alignment posts 215 of connector 212 upon mating the connector 212 to the end of the insulated strip 238.

As can be seen in FIG. 7, the cutting edges 172 of terminals 160 in connector 212 extend a second selected distance beyond the mating face 216, the second selected distance being less than the first selected distance. Upon mating the connector 212 with the insulated strip 238, the alignment pins 215 are received in the respective apertures 241 thus aligning the respective terminals 160 with the corresponding conductors 46 in the insulated strip 238 prior to the leading end of terminals 160 engaging strip 238. The cutting edges 172 of the terminals 160 cut into the conductor 46 a selected axial distance such that a first portion 252 of the conductor is received in recess 174 of terminal 160 in the same manner previously described with the terminal 60. The resulting termination 176 provides a assured electrical connection between the terminals 160 of the connector 212 and the respective conductors 46 in the insulated strip 238.

The terminal and termination of the present invention provide a secure mechanical and electrical connection between the conductor 46 and the terminal 60. The invention further provides a secure mechanical and electrical connection directly between terminals 160 of connector 212 and conductors 46 of strip 238. The present invention eliminates the need for the use of a conductive gel or adhesive as taught by the prior art. The present invention is more cost effective to manufacture and assemble than the connector of the prior art.

It is thought that the electrical terminal, the connector and termination of the present invention and many of its attendant advantages will be understood from the foregoing description. It is apparent that various changes may be made in the form, construction, and arrangement of parts thereof without departing from the spirit or scope of the invention or sacrificing all of its material advantages.

I claim:

1. A termination of a conductor and a terminal comprising:

an electrical conductor having insulation therearound and extending to an end exposed at an end of the insulation, the conductor having a selected transverse dimension, and a terminal having a termination end, said termination end having at least a pair of cutting edges aligned with said conductor, said cutting edges being spaced closer together than said selected transverse dimension, said cutting edges being sliced into the end of the conductor a selected axial distance and receiving a first portion of said conductor between said cutting edges and outer portions of said conductor along outer surfaces of the termination end of the terminal.

2. The termination of claim 1 wherein outer surfaces of said terminal are angled to diverge away from said termination end.

3. The termination of claim 1 wherein said termination end has a frustoconical outer profile.

4. The termination of claim 1 wherein said conductor is flat.

5. The termination of claim 1 wherein said end of the conductor is recessed from the end of the insulation and exposed at an inner end of an opening aligned with the conductor.

6. A method of terminating a conductor and a terminal comprising the steps of:

selecting an electrical conductor having insulation therearound and extending to an end exposed at an end of the insulation, the conductor having a selected transverse dimension;

selecting a terminal having a termination end, said termination end having at least a pair of cutting edges;

aligning said cutting edges with said conductor;

slicing the end of the conductor a selected axial distance with said cutting edges; and receiving a first portion of said conductor between said cutting edges and outer portions of said conductor along outer surfaces of the termination end of the terminal.

7. The method of terminating a conductor and a terminal of claim 6 further including the step of providing an opening in said insulation and aligned with said conductor such that the end of the conductor is exposed at a base of said opening.

8. An assembly of the type used to connect two electrical articles, at least one of which is an elongate strip having conductors extending therethrough and exposed at an end surface thereof, said assembly including a housing having a mating face and at least two terminals disposed therein, the terminals having connecting sections exposed along said mating face, said assembly and strip being securable by a fastening member, the assembly being characterized in that:

said elongate strip includes an opening extending therein into from said end surface aligned with each said elongate conductor and exposing an end thereof, each said conductor end being thus recessed from the end surface of said elongate strip; and an electrical terminal is disposed in each said opening such that an inner end thereof is in electrical engagement with the respective conductor and a mating end of said terminal extends from said end surface for engagement with said terminals of said connector, said terminal including a termination end having at least a pair of cutting edges aligned with said conductor, slicing said conductor a selected axial distance and receiving a first portion of said conductor between said cutting edges and outer portions of said conductor along outer surfaces of the termination end of the terminal.

9. The assembly of claim 8 wherein outer surfaces of said terminal are angled to diverge away from said termination end.

10. The assembly of claim 8 wherein said termination end has a frustoconical outer profile.

11. The assembly of claim 8 wherein said conductor is flat.

* * * * *